US005993182A

United States Patent [19]

Beldy et al.

[11] Patent Number: 5,993,182

[45] Date of Patent: Nov. 30, 1999

[54] REVERSIBLE CONVERTER OF DIRECTION OF MOVEMENT AND DEVICE FOR DISPLACING VOLUMES USING SAID CONVERTER

[76] Inventors: Nikolai Nikolaevich Beldy; Vitaly Nikolaevich Beldy, both of proezd Gaidara, 15, 28006 Khmelnitsky, Ukraine

[21] Appl. No.: 08/930,899

[22] PCT Filed: Mar. 7, 1996

[86] PCT No.: PCT/UA96/00005

§ 371 Date: Oct. 6, 1997

§ 102(e) Date: Oct. 6, 1997

[87] PCT Pub. No.: WO96/31684

PCT Pub. Date: Oct. 10, 1996

[30] Foreign Application Priority Data

Apr. 4, 1995 [UA] Ukraine ..... 95041532

[51] Int. Cl.[6] ..... F01C 3/06

[52] U.S. Cl. ..... 418/68; 418/195; 366/279

[58] Field of Search ..... 418/68, 195; 366/276, 366/279

[56] References Cited

U.S. PATENT DOCUMENTS

| | | | |
|---|---|---|---|
| 826,985 | 7/1906 | Appel | 418/68 |
| 1,904,373 | 4/1933 | Kempthorne | 418/68 |
| 1,952,260 | 3/1934 | Kempthorne | 418/68 |
| 2,043,544 | 6/1936 | Kempthorne | 418/68 |
| 3,492,974 | 2/1970 | Kreimeyer | 418/68 |
| 3,730,145 | 5/1973 | Bennetto | 418/68 |
| 4,631,011 | 12/1986 | Whitfield | 418/68 |
| 5,199,864 | 4/1993 | Stecklein | 418/68 |

FOREIGN PATENT DOCUMENTS

| | | |
|---|---|---|
| 666286 | 6/1979 | U.S.S.R. . |
| 1236209 | 6/1986 | U.S.S.R. . |
| 1583668 | 8/1990 | U.S.S.R. . |
| 88/0398 | 6/1988 | WIPO . |
| 90/07632 | 7/1990 | WIPO . |

*Primary Examiner*—John J. Vrablik
*Attorney, Agent, or Firm*—Abelman, Frayne & Schwab

[57] ABSTRACT

A reversible converter of direction of motion, in which all geometric axes of rotating parts cross each other at one point, comprises: a body; a shaft, rotatably mounted in the body; a guide rigidly connected to the shaft and made in the form of a body of revolution, said guide having an annular groove, the plane of symmetry of which is inclined toward the rotation axis of the shaft and passes through said intersection point; a blade operatively connected to the annular groove of the guide through an intermediate connecting member, said blade being mounted in the body on half-axles for taking up the rotation of the shaft or rotating said shaft. The invention also pertains to a positive displacement machine which comprises oscillating working elements and utilizes said converter.

10 Claims, 8 Drawing Sheets

REVERSIBLE CONVERTER OF DIRECTION OF MOVEMENT AND DEVICE FOR DISPLACING VOLUMES USING SAID CONVERTER

TECHNICAL FIELD

The invention relates:

to mechanical arrangements and particularly to a design of reversible converters of the direction of motion, and more particularly, to devices designed for converting shaft rotation into oscillating motion of working elements (for example, of the type of vanes), operatively connected to the shaft or the oscillating motion of said working elements into the shaft rotation; and to mechanical arrangements and particularly to a design of positive displacement machines utilizing oscillating working elements, based on said converters.

Said converters can be used:

for transmission of motion to working elements, for example: to the blades of mixers for preparation of mixtures unspecified as for their composition and based on liquid dispersion media or to propellers of the "fish tail" type for vessels, etc., and as a unified base of said positive displacement machines utilizing oscillating working elements.

Said machines can be used:

(on exerting force upon the shaft) as:

pumps, preferably vacuum pumps, or compressors and positive displacement metering pumps, preferably for liquids;

(on applying compressed gas or liquid under pressure alternately to both inlet ports and on utilizing the shaft for taking up and transmitting torque) as:

pneumatic or hydraulic motors, or preferably flowmeters, mainly of liquids.

Said fields of application are typical for uni- and multi-sectional machines according to the invention.

Utilization of a plurality of such machines, aggregated about a common shaft, allows production of:

multistage pumps or compressors of high pressure, air or hydraulic starters mainly for heavy-duty Diesel engines, preferably for vessels.

And, at last, the utilization of a plurality of such pneumatically or hydraulically connected machines allows production of synchronous pneumatic or hydraulic drives preferably for heavy-loaded conveyors.

BACKGROUND ART

Positive displacement machines are widely used in modern engineering. Many of them are products of mass or large-scale production.

Therefore it is highly desirable that these machines possess:

as high as possible reliability;

as high as possible specific power and, accordingly, as low as possible specific material consumption in manufacturing;

as great as possible efficiency and, accordingly, as low as possible specific energy consumption per unit of performance, and last but not least, as great as possible pliability to unification regardless of a specific application.

As far as such machines are based on converters of the direction of motion, the combined attainment of said requirements is substantially dependant upon the development of the latter.

Converters of the direction of motion for positive displacement machines generally comprise a shaft and an optional working element (usually rigidly) connected to the shaft capable either of affecting a fluid (liquid or gaseous) medium during the rotation of the shaft or of taking up the pressure of such medium and converting it into the rotation of the shaft.

Widely known is, for example, a vane converter of rotary motion comprising a shaft rotatably mounted on at least one bearing and at least one vane preferably radially fixed to the shaft (see, for example: Политехнический словарь.-Издательство "Советская Энциклопедия, Москва, 1976, с.260, "Лопаточная машина" (Politechnical Dictionary. Soviet Encyclopaedia Publishing House, Moscow, 1976, p. 260, entry Vane Machine)).

As specific references to the utilization of the converters of such type can be cited: Rotor Pump (U.S. Pat. No. 3,985,473); Vortex Turbo-Machine (Accepted Application of Japan 2-291499 (1990)); Positive Displacement Engine (Soviet Author's Certificate 600323) and many other pumps, compressors and hydraulic or pneumatic engines.

Vane converters and positive displacement machines based thereon are sufficiently widespread and, as a rule, are rather reliable. Some of them have rather high efficiency and specific power.

However they are so diverse in designs that only classification lists, not speaking of the detailed description of the prior art, can take tens of pages. In the practice of public production and consumption, where since long time is being observed a tendency towards increasing of a proportion of hydraulic and pneumatic devices in the total mass of industrial production, said diversity results in unjustified industrial and operational costs.

Therefore there exists an evergrowing demand for providing such reversible mechanical converter of direction of motion on which could be generally based designs of essentially different as for their application machines and, in particular, positive displacement machines.

It is expedient that designs of such converters are based on general principles of providing spatial, and more particularly, spherical mechanisms such as "universal hinge" (see, for example, Артоболевский И.И. Теория механизмов и машин; Учебник для втузов. 4-е изд. перераб. и доп. М.: Hayka, 1988—The Theory of Mechanisms and high schools.—4-th revized edition. Moscow, Nauka Publishing House, 1988).

A common reversible converter of direction of motion of such type comprises a body, a shaft rotatably mounted in the body, a guide rigidly connected to the shaft, and at least one element operatively connected with the guide for taking up the rotation of the shaft or to transmit rotation to the shaft. Then, the geometric axes of rotation of all members cross each other at one point (Ibid. pp. 168–172, FIGS. 8.3 and 8.4). In particular, shown in FIG. 8.3 spherical four-member assembly comprises a body in the form of a carrier ring having projections spaced at an angle of >0° to <90°, two shafts jointed in said projections each of which being either an input or an output depending on the connection to an engine and each of which being rigidly connected with guides in the shape of forks (or yokes) articulated at the ends by means of a spider.

This device serves only for transmission of rotation at an angle to a geometric axis of the input shaft and cannot be used in positive displacement machines.

It should be noted that further attention must be paid to "rotor" positive displacement machines of which an acceptable analog for a comparison with the invention can be, for example, "Rotor Pump or Engine with Spherical Body" according to U.S. Pat. No. 5,127,810.

Said positive displacement device comprises a movable body in the form of a body of revolution (and particularly in the form of the mentioned sphere) divided into two hemispherical parts by means of a blade-type working element (and particularly, disk) connected to a reversible converter of direction of motion adapted to convert rotary motion (of the body) into oscillating motion of the disk (or vice versa). Said converter is based on opposed wedge-like members mounted in the body's interior and lying at opposite sides of the disk being pivotally connected therewith, the geometric [pivotal] axes of rotation of said wedge members being orthogonal to one another and intersecting at the sphere centre.

Having rather high specific power and acceptable efficiency, said positive displacement machine reveals lower reliability when higher mechanical loads are exerted upon said wedge-like members and joints connecting said members with the disk.

DISCLOSURE OF INVENTION

Therefore the invention is based on a problem:

by changing the mechanical arrangement and the design of the "universal hinge", to provide such reversible converter of direction of motion which can serve as a unified base for various machines utilizing a rotary motion either at an input or at an output, preferably reversive positive displacement machines for various purposes including at least compressors or pneumatic motors, pumps or fluid-power motors, positive displacement meters and metering pumps, and, further, utilizing said converter, to provide a positive displacement machine comprising oscillating working elements being more reliable in use.

The above problem is solved in that in a reversible converter of direction of motion based on a universal hinge having a body, a shaft rotatably mounted in the body, a guide rigidly connected to the shaft, and at least one part operatively connected with the guide for taking up the shaft rotation or rotating said shaft, wherein the axes of rotation of all the members being intersected at one point, according to the invention, the guide is formed in the shape of a body of revolution having an annular groove the symmetry plane of of which is inclined toward the rotation axes of the shaft and passes through the intersection point of the aformentioned axes, and the member being the terminus in the mechanical linkage and connected with the guide is made in the form of a working element adapted for affecting a fluid medium or taking up the pressure of the fluid medium being operatively connected with the body by means of two opposed half-axles and provided with an intermediate engaging member mounted for motion in said annular groove of the guide.

Said combination of features characterizes a reversible hydromechanical converter of direction of motion that can be a unified base for machines of various classes.

According to the first additional characteristic feature, the body and the working element are formed in the shape of a fork or a yoke, and the guide is formed in the shape of a flat washer. A hydromechanical converter of direction of motion having such characteristics is the most suitable for equipping impeller mixers therewith and for use in combination with propellers of the "fish tail" type.

According to the second additional characteristic feature, the body is made in the form of a housing having a wall the inner side of which is confined by the surface of a body of revolution, the working element is formed in the shape of a blade having a round central hole confined by a spherical surface and enclosing the guide, and the guide is made in the form of a spherical body the annular groove of which contains an annular insert mounted flush with the surface of the sphere, said insert having at least one recess adapted for mounting the intermediate engaging member. Hydromechanical converter of direction of motion having such characteristics is most suitable for use as a unified base of positive displacement machines According to the third additional characteristic feature, the intermediate engaging member is made in the form of a ball. It provides for the most reliable connection of the blade with the guide.

According to the fourth additional characteristic feature, the housing interior is confined by a spherical surface, and a blade having a central hole is made in the form of preferably a split ring. Such converter arrangement is useful when utilized in pumps and compressors or in pneumatic and hydraulic motors.

According to the fifth additional characteristic feature, the housing interior is confined by a cylindrical surface being symmetric about the opposed half-axles, and the blade having a central hole is made in the form of rectangular plate. Such converter arrangement is useful when utilized in positive displacement metering pumps or flowmeters.

The abovementioned problem is solved also in that in a positive displacement machine with oscillating working elements, comprising a hollow housing with ports in the wall thereof for letting in and out a fluid medium, whose interior is confined by the surface of a body of revolution, and a blade-type working element mounted in said interior and connected to a reversible converter of direction of motion adapted to convert rotation of the input kinematic member of the machine into oscillating motion of the bladetype working element or the oscillating motion of said element into rotation of the output kinematic member, according to the invention, the reversible converter of direction of motion is based on a universal hinge having geometric axes of all the rotating parts intersecting at one point, the housing of the machine serving for a body of the converter which comprises a shaft mounted in the housing for rotation as an input or output kinematic member, a spherical guide rigidly connected to the shaft and having an annular groove the symmetry plane of which being inclined toward the rotation axis of the shaft and crossing the intersection point of the mentioned axes, and an intermediate engaging member mounted for motion in said annular groove of the spherical guide and engaged with the blade-type working element having a central hole enclosing the spherical guide, and being further operatively connected with the housing by means of two opposed half-axles whose geometric axes being perpendicular to the geometric axis of the shaft, said housing further enclosing a rigid partition having a symmetry plane including the geometric axes of the shaft and said half-axles and comprising recesses for mounting the guide and said half-axles.

BRIEF DESCRIPTION OF DRAWINGS

The invention is further explained by way of detailed description of design and operation of the claimed reversible converter of direction of motion and some positive displacement machines based thereon with reference to the accompanying drawings, in which:

BEST MODE FOR CARRYING OUT THE INVENTION

Figure 1:
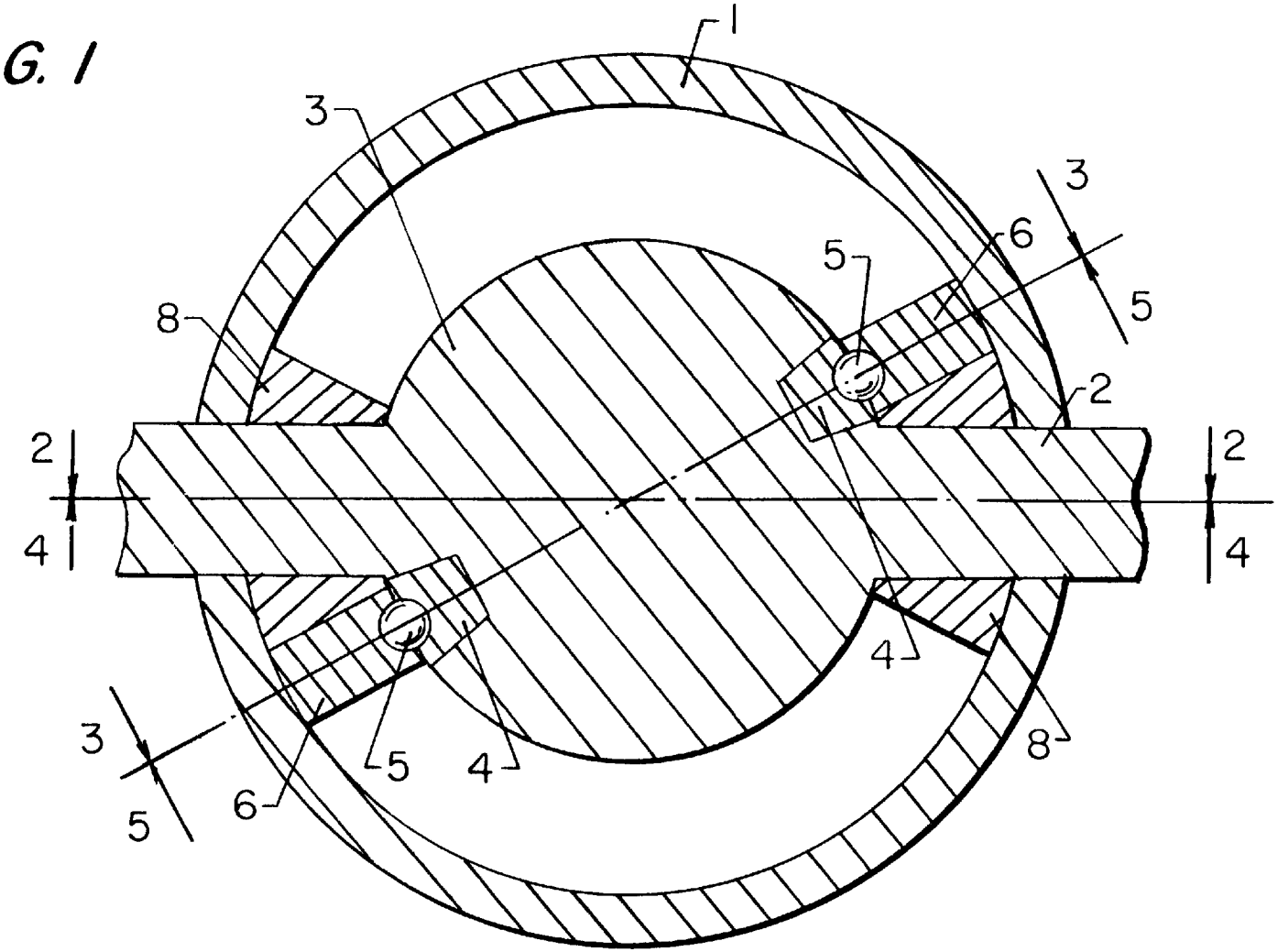
FIG. 1 is a positive displacement machine with oscillating working elements comprising a housing with a spherical or cylindrical interior (a longitudinal sectional view in the transverse plane of symmetry of the working element)

The positive displacement machine of the invention comprises the following main parts (FIG. 1):

housing 1 having at least one pair of opposed coaxial holes and at least two more [other] non-axial (or pairwise coaxial) holes for accommodation of the named below parts all having their geometric axes of rotation intersected at one point and made:

in the shape of a fork or yoke (which for the sake of simplicity are not shown in the drawings)—in the case when the converter is utilized, for example, for a drive of an impeller mixer or a propeller of the "fish tail" type or in the form of a housing having a wall which can be provided with mentioned further additional holes (alongside with the mentioned holes) for inlet and/or outlet of fluid medium and whose interior is confined by a surface of a body of revolution (mainly spherical, as in FIGS. 1, 2 and 3, or, for example, cylindrical, as in FIGS. 4 and 5)—in the case when the converter constitutes the base of a positive displacement machine;

a shaft 2 mounted in suitable rolling contact or plain bearings provided with appropriate seals (such bearings and seals are not shown for the sake of simplicity):

either in one through hole of the housing 1, formed in the shape of the mentioned above yoke, or in two coaxial holes (one of which can be blind) made in the wall of the hollow housing 1;

guide 3 rigidly connected to the shaft 2 and having an annular groove whose plane of symmetry is inclined toward the rotation axis of the shaft 2 and passes across the intersection point of the mentioned above axes and made:

either in the form (not shown in the drawings) of a round washer with an open circumferential [annular] groove (particpularly, for utilization in the above mentioned impeller mixer) for engagement with a pin not shown in the drawings;

or in the form of a spherical body (in particular being integral with the shaft 2) having a similar annular groove, in which a ring insert 4 can be mounted flush with the surface of said spherical housing, said insert having at least one (preferably spherical) recess for an engaging member of a pin type or preferably a ball 5;

a blade 6 connected with the guide 3 by means of the mentioned pin or said ball 5 and which is in the form of either a plate of preferably horseshoe shape (not shown in the drawings) if designed for use as a mixing member (such plate is to be mounted on half-axles in the opposed coaxial holes made in the housing 1 formed in the shape of a fork or yoke), or a plate having a round central hole, which has a spherical surface along the circumference of this central hole and slidably encloses the spherical guide 3 and is mounted for oscillating about diametrically opposed end half-axles 7 (See FIGS. 2 and 3, 4 and 5) in the holes of the wall of the housing 1 made in the form of a hollow housing.

Figure 6:
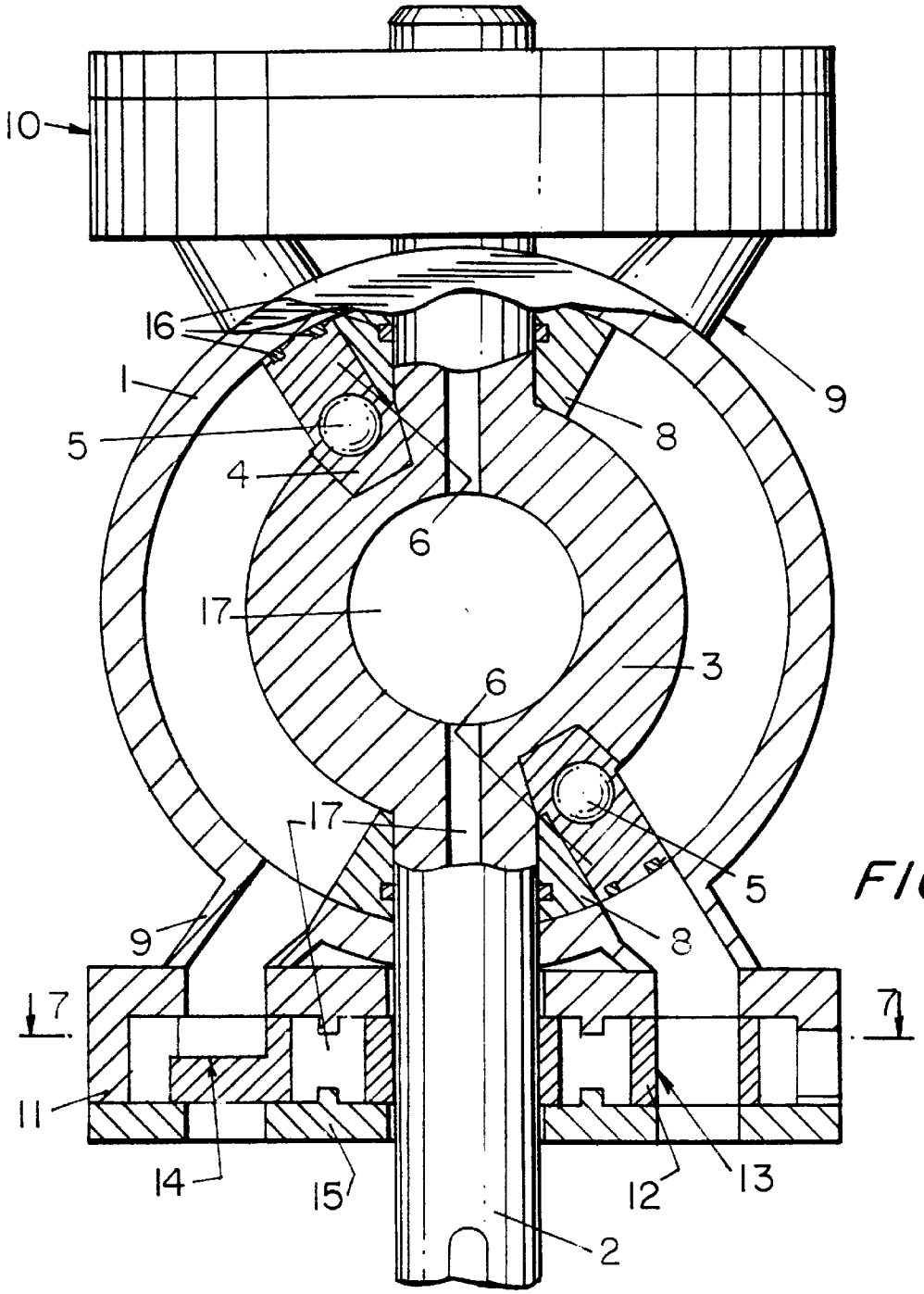
FIG. 6 is a general view of the positive displacement machine with oscillating working elements in combination with a valve-controlled mechanism (longitudinal section in the transverse plane of symmetry of the working element, wherein the distributive disk is revolved through an angle "alpha).

The shaft 2 can have a through channel, and the guide 3 can be made hollow (as is seen in FIG. 6) to facilitate the lubrication of friction surfaces.

Figure 3:
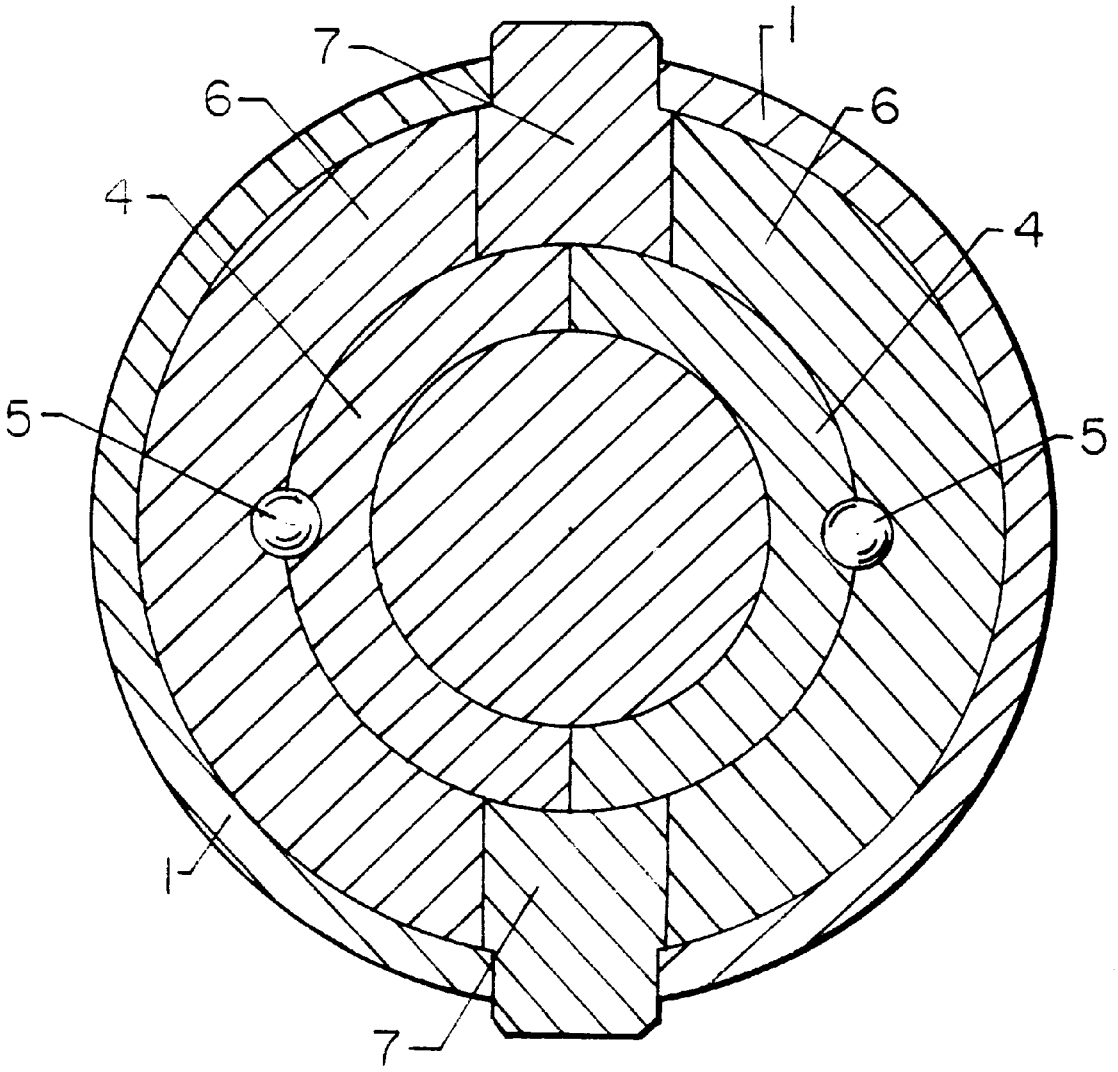
FIG. 3 is a section taken along the line III—III in FIG. 1 (in the longitudinal plane of symmetry of the working element)
Figure 4:
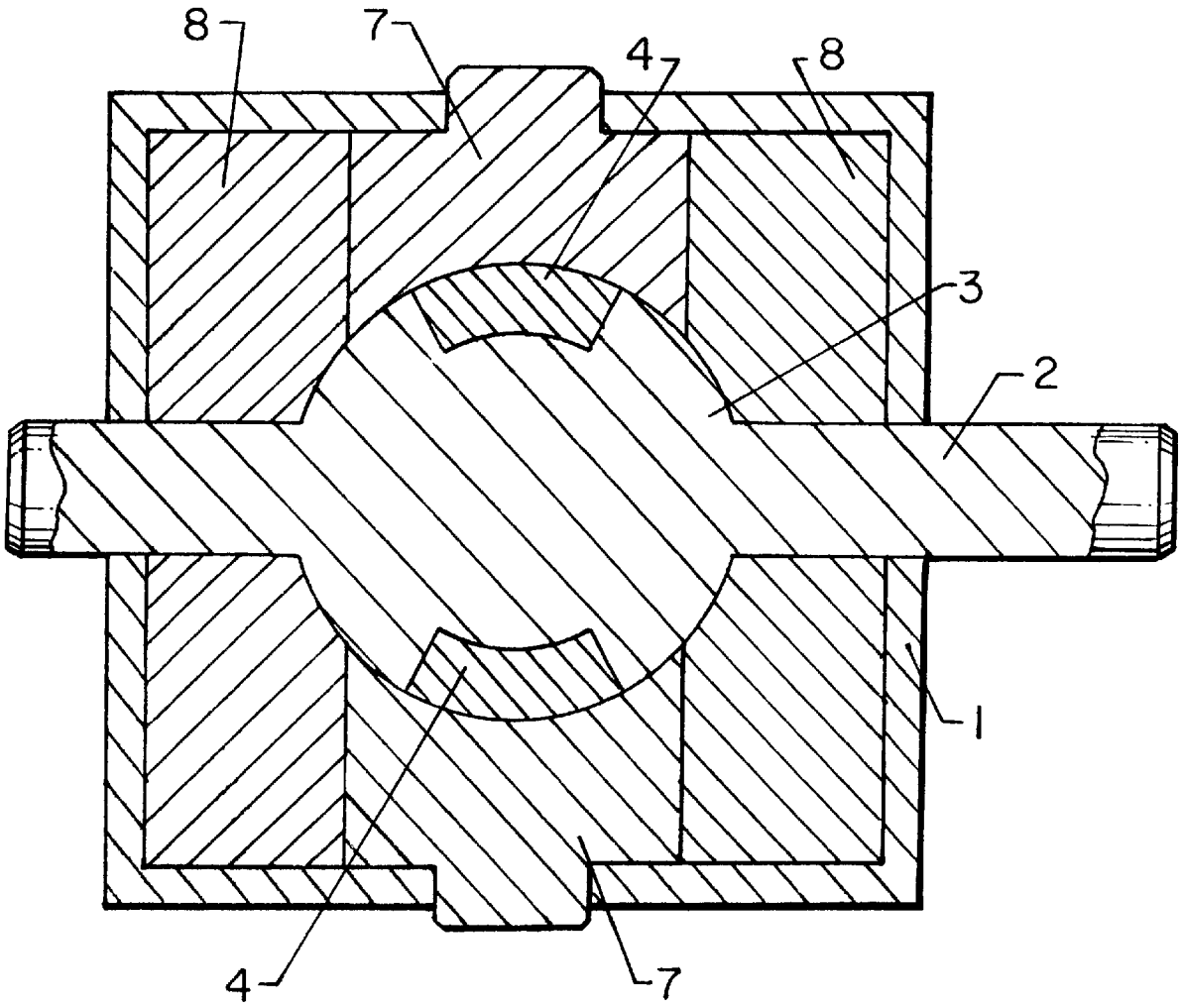
FIG. 4 is a section taken along the line IV—IV in FIG. 1 (for the case of the cylindrical operative interior)
Figure 5:
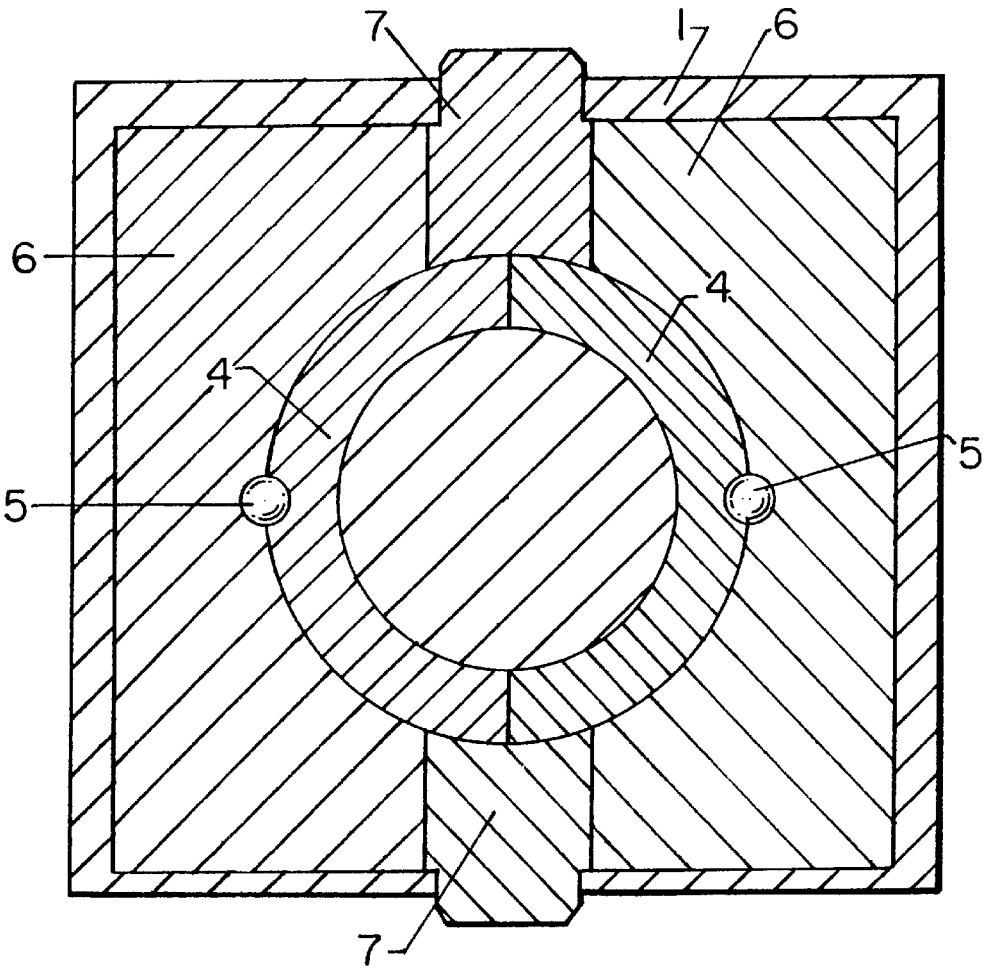
FIG. 5 is a section taken along the line V—V in FIG. 1 (in the longitudinal plane of symmetry of the working elements—for the case of the cylindrical operative interior)

The ring insert 4 can be made:

either completely or at least with a coating of an antifriction material which reduces friction against the walls of the annular groove in the guide 3 and preferably consisting of two jointed semi-rings which facilitates its assembly at manufacturing or replacement at repair (FIGS. 3 or 5).

The blade 6, enclosing the spherical guide 3, for the convenience of assembly can be made in the form of two parts either butt-jointed or imposed one on another. When used in the housing 1 having a spherical interior, referring to FIG. 3, the blade 6 has in the plan view the shape of a ring which can be provided with a suitable outer circumferential seal, and for the bodies with a cylindrical interior said blade has the shape of a rectangle, preferably a square (FIG. 5) with rounded corners.

Half-axles 7 can be secured against rotation:

either in the ring-shaped blade 6, which is preferable as for the convenience in manufacturing and reliability of packing in positive displacement machines or in the fork-shaped housing 1, which is preferable when the claimed converter of direction of motion is utilized in drives of impeller mixers or propellers of the "fish tail" type.

Bodies 1 having a spherical inerior and a ring-shaped blade 6 are preferable when the claimed converter of direction of motion is utilized in combination with such positive displacement machines as pumps and compressors or pneumatic and hydraulic motors; and bodies 1 having a cylindrical interior (or a conical interior—not shown) and an appropriately shaped blade 6 are preferable for flowmeters and positive displacement metering pumps.

Referring to FIG. 5, the axis of symmetry for cylindrical (and conical) bodies 1 in all cases is the geometric axis of the half-axles 7. Conical bodies can be made by way which can be readily understood by those skilled in the art—in the form of two truncated cones facing each other by the large bases.

Figure 2:
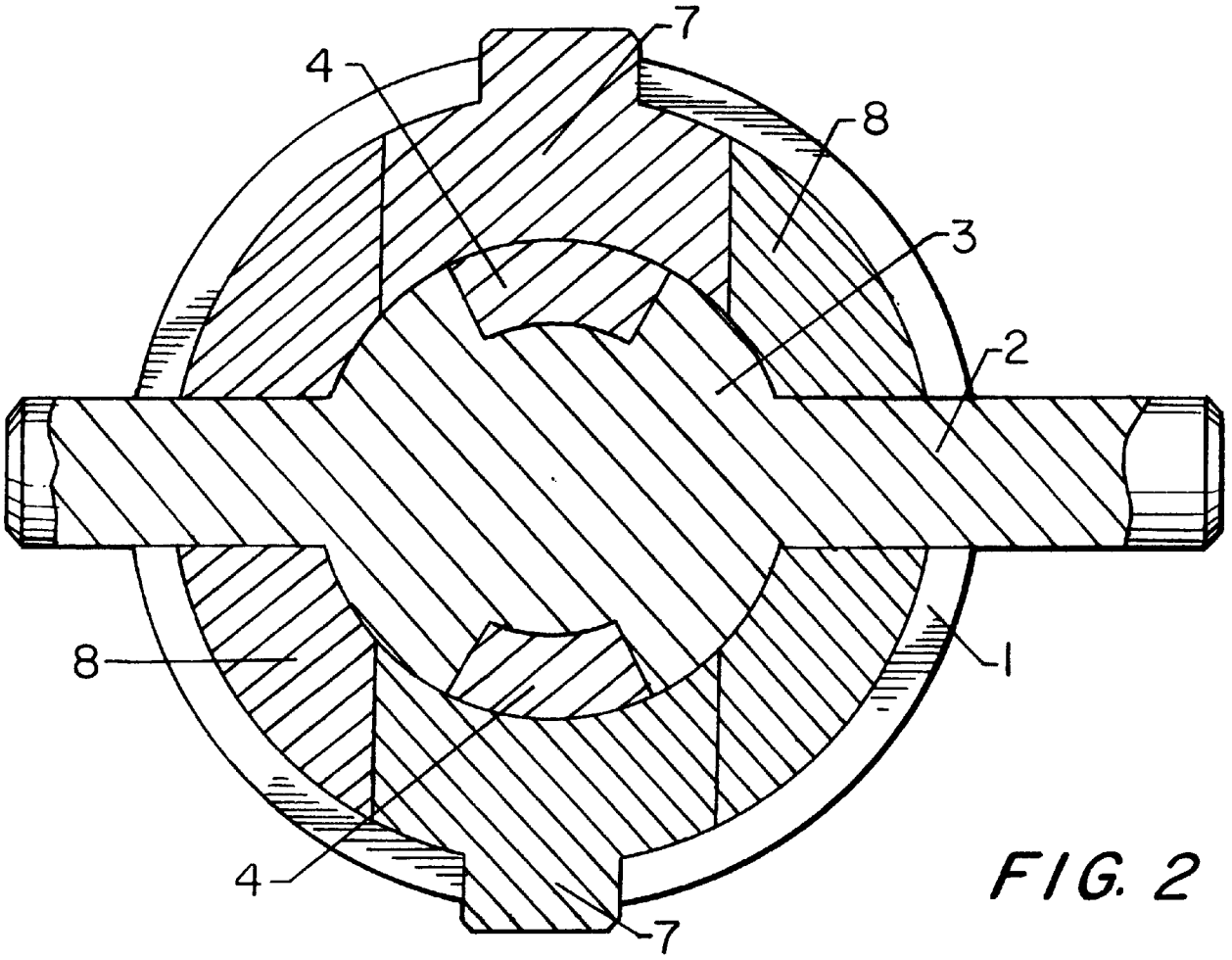
FIG. 2 is a section taken along the line II—II in FIG. 1.

The claimed positive displacement machine with oscillating working elements based on the described converter of direction of motion further comprises the following additional parts (FIG. 6):

a rigid partition 8, whose plane of symmetry includes the geometric axes of the shaft 2 and the half-axles 7, having spherical and cylindrical resesses for accommodation of the respective guide 3 and half-axles 7 (said partition 8 is also seen in FIG. 1);

pipe connections 9 for admission and discharge of fluid media and at least one valve-controlled (preferably disk-type) mechanism 10.

Figure 7:
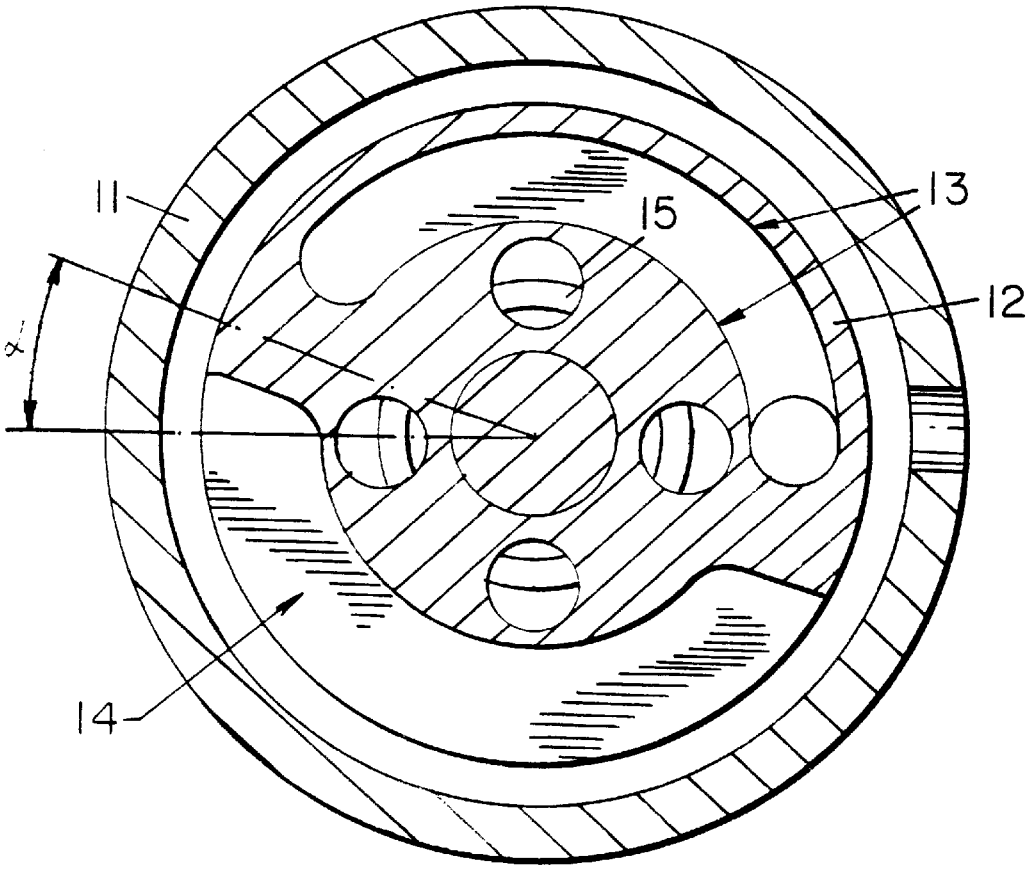
FIG. 7 is a transverse section taken along the line VII—VII in FIG. 6, showing the valve-controlled mechanism.

As can be best noted in FIGS. 6 and 7, said mechanism 10 comprises:

a cylindrical casing 11 having a bottom part rigidly connected to the housing 1, and an end side protruding over the bottom part, which comprises:

a central hole through which the shaft 2 is free to pass, two through end holes of equal diameters made in the bottom part and equidistantly spaced at opposite sides of the geometric axis of the shaft 2, which reduce into the pipe connections 9, and at least one periphery port (usually for injection) made in the end side;

a distributive disk 12 (FIG. 7), rigidly connected to the shaft 2 and having:

a crescent-shaped aperture confined by a wall 13 and a crescent-shaped recess open in the direction of the side of the cylindrical casing 11 and confined at the opposite side by a wall 14, said recess being equal as to the volume to said crescent-shaped aperture;

an end cover 15 having two through ports (usually for suction).

FIG. 6 also schematically illustrates sealing elements 16 and oil ducts 17.

In some embodiments of the invention (obvious for those skilled in the art and therefore not shown especially) the distributive disk 12 of the valve-controlled mechanism 10 can be mounted in a recess made in the outer side of the wall of the housing 1 of the machine, suitable ports in the wall of this housing 1 can substitute for pipe connections 9.

As the blade 6 of an isolated positive displacement machine suffers from dead centers, it is advisable to provide the shaft 2 with a flywheel. In the simpliest cases (for example, when said machine is utilized as a flowmeter) the function of said flywheel can perform the very shaft 2 with the guide 3 and the distributive disk 12. Pneumatic or hydraulic motors based on the machine of the invention can be provided with the shaft 2 being eccentrically weighted, and in other cases of application, when the shaft 2 is connected to a rotation drive, the function of said flywheel can perform rotative parts of a particular engine.

Figure 8:
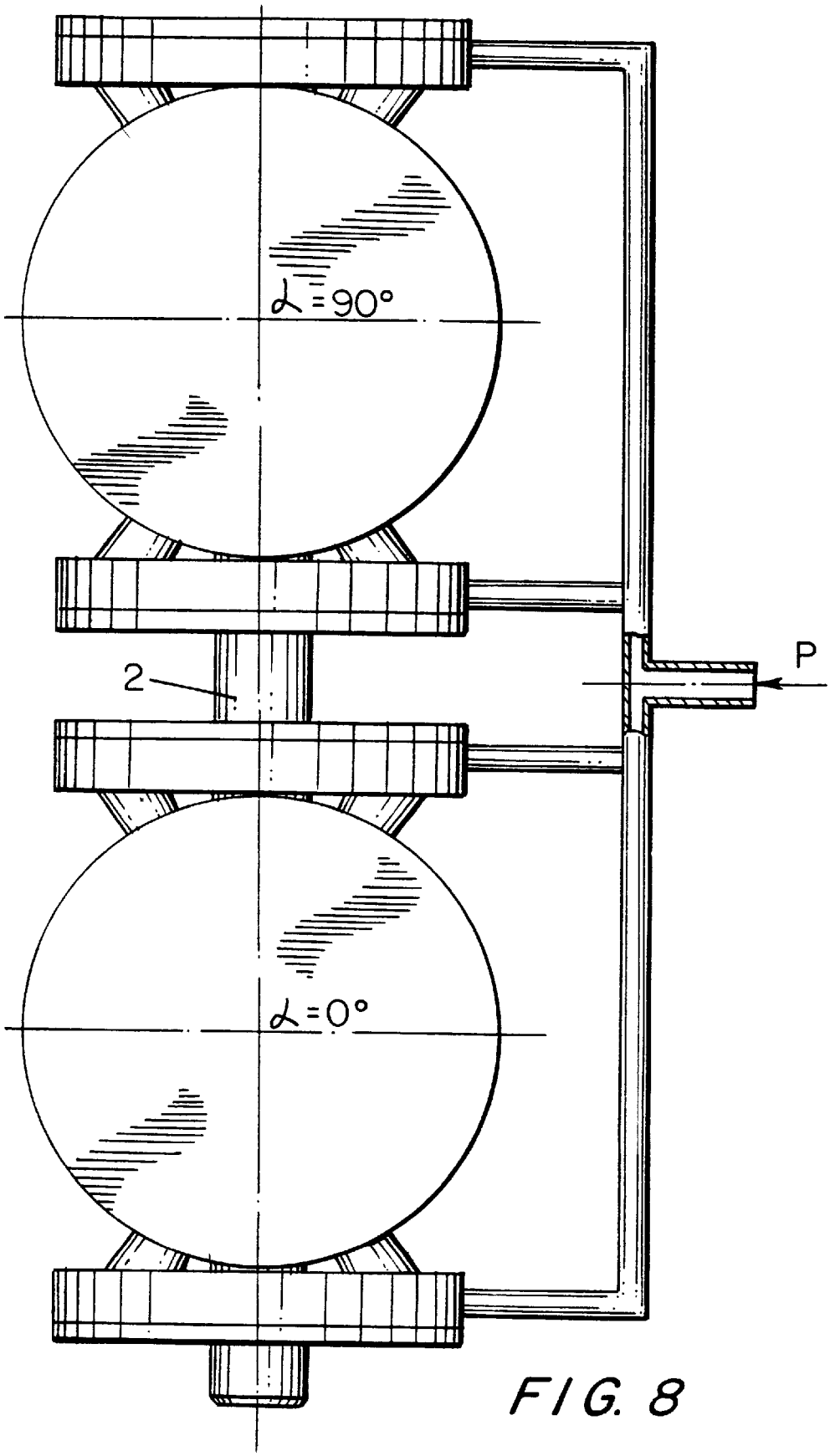
FIG. 8 is a pneumatic or hydraulic motor based on a tandem positive displacement machine with oscillating working elements (having a common output shaft and with angular displacement of the working elements in different units).

Referring to FIG. 8, pneumatic or hydraulic motors (and, accordingly, compressors or pumps) can be preferably formed of at least two claimed positive displacement machines having blades 6 mounted on a common shaft 2 in phase quadrature and which are connected in parallel to a common discharge (or injection) mainline.

In multisectional pumps or compressors based on the positive displacement machine of the invention another important effect is achieved —smoothing of pressure fluctuation at the output.

Two principal variants are possible, in the first of which the housing 1 is fixed, and in the second, the shaft 2 is fixed.

The second variant is preferable as a means of overcoming the dead centers, however in the most cases it is inexpedient and consequently, being clear to the workers in the art, it is not considered here.

As far as the claimed converter of direction of motion is reversible, the first variant, that is with the housing 1 being fixed, also provides for two modes of operation, namely:

either applying a load to the shaft 2 (in a mode of injecting or metering out a fluid medium), or by applying a load to the blade 6 (in a motor or a flowmeter).

The operation in the mode of injection will now be described with reference to FIG. 6, if not otherwise stated.

Upon rotation of the shaft 2 the guide 3 forces the ring insert 4 to revolve in the annular groove constantly in same direction. The ring insert 4 thrusts the ball (or balls) 5 which, rolling in the sockets of the insert 4, force the blade 6 to swing.

At each oscillating motion of the blade 6:

a vacuum is created behind it, accordingly, in those parts of the interior in the housing 1 which are confined by the partition 8 and (at a particular stage of process) back side of the blade 6, a fluid medium is injected through a part of channels of the valve-controlled mechanism 10 which open upon rotation of the distributive disk 12 and corresponding pipe connection 9, and in front of it an increased pressure is created, accordingly, from those parts of the interior in the housing 1 which are confined by the partition 8 and (at a particular stage of process) the front side of the blade 6, a compressed fluid medium is ejected through the other part of channels of the valve-controlled mechanism 10 which open upon rotation of the distributive disk 12 and corresponding pipe connection 9, into an outlet pipe.

Upon alternately applying load (that is fluid medium under pressure incoming through the valve-controlled mechanism 10) at the blades 6, mounted in the housing interior at different sides of the partition 8, the process goes in the order contrary to the described above, namely:

while oscillating, the blade 6 through the ball(s) 5 thrusts and revolves the ring insert 4, this insert 4 rotates the guide alongside with the output shaft 2, from which the payload is received.

While particular embodiments of the invention have been shown and described, various modifications thereof will be apparent to those skilled in the art and therefore it is not intended that the invention be limited to the disclosed embodiments or to the details thereof and departures may be made therefrom within the spirit and scope of the invention as defined in the claims.

Industrial Applicability

The described invention can be realized with the utilization of known in the industry materials, equipment and tools.

Among the most preferable embodiments of the invention special attention should be payed to those associated with positive displacement flowmeters and metering pumps as well as vacuum pumps for milking units.

We claim:

1. A reversible converter of direction of motion based on a spherical mechanism having geometric axes of rotation of all members intersecting at one central point, which comprises:

a housing;

a shaft rotatably mounted in said housing;

two opposed half-axles mounted in said housing and having their geometric axis orthogonal to the geometric axis of the shaft and intersecting therewith in said central point;

a spherical guide rigidly connected to said shaft and comprising an annular groove having the symmetry plane inclined toward the rotation axis of said shaft and including said central point;

a blade having a central hole enclosing the guide and adapted for oscillating motion and operatively connected with the housing by means of said half-axles; and at least one intermediate engaging member operatively connected with said annular groove of said guide and with said blade and being adapted to swing the blade during rotation of the shaft or to rotate the shaft during oscillation of the blade.

2. The reversible converter of claim 1 having a ring insert mounted flush with the surface of the sphere in said annular groove of said guide, said insert having at least one recess for mounting said intermediate engaging member.

3. The reversible converter of claim 2 having said intermediate engaging member made in the form of a ball.

4. The reversible converter of claim 1 having the housing interior confined by a spherical surface, and said blade being made in the form of a plate with a round circumference.

5. The reversible converter of claim 1 having the housing interior confined by a cylindrical surface being symmetric about the geometric axis of said half-axles for said blade, and said blade being made in the form of a plate having a substantially rectangular periphery.

6. A positive displacement machine based on a reversible converter of direction of motion in the form of a spherical mechanism having the geometric axes of rotation of all members intersecting at one central point, which comprises:

a hollow housing having a wall confined from inside by the surface of a body of revolution and having ports for injecting and ejecting a fluid medium, a valve-controlled mechanism for connecting the interior of said hollow housing to a respective source and receptacle of a fluid medium through said ports, a shaft received in the interior of said housing through at least one through hole, two opposed half-axles mounted in said housing and having their geometric axis orthogonal to the geometric axis of said shaft and intersecting therewith in said central point, a spherical guide rigidly connected to said shaft and comprising an annular groove having the symmetry plane inclined toward the rotation axis of said shaft and including said central point, a rigid partition mounted in the interior of said housing, which partition having a plane of symmetry including the geometric axes of said shaft and half-axles and being provided with recesses for accommodation of said guide and half-axles, a blade having a central hole tightly enclosing said guide, mounted in said housing for oscillating motion and operatively connected with said housing by means of said half-axles, and at least one intermediate engaging member operatively connected with said annular groove of said guide and with said blade and being adapted to swing the blade during rotation of the shaft or to rotate the shaft during oscillation of the blade.

7. The positive displacement machine of claim 6 having a ring insert mounted flush with the surface of the sphere in said annular groove of said guide, said insert having at least one recess for mounting said intermediate engaging member.

8. The positive displacement machine of claim 7 having said intermediate engaging member made in the form of a ball.

9. The positive displacement machine of claim 6 having the housing interior confined by a spherical surface, and said blade being made in the form of a plate with a round circumference.

10. The positive displacement machine of claim 6 having the housing interior confined by a cylindrical surface being symmetric about the geometric axis of said half-axles for said blade, and said blade being made in the form of a plate having a substantially rectangular periphery.

* * * * *